US007316412B2

(12) United States Patent
Couderc

(10) Patent No.: US 7,316,412 B2
(45) Date of Patent: Jan. 8, 2008

(54) DEVICE FOR RETAINING A FOOT OR A BOOT ON A SPORTS APPARATUS

(75) Inventor: Bernard Couderc, Annecy (FR)

(73) Assignee: Salomon S.A., Metz (FR)

( * ) Notice: Subject to any disclaimer, the term of this patent is extended or adjusted under 35 U.S.C. 154(b) by 134 days.

(21) Appl. No.: 10/930,781

(22) Filed: Sep. 1, 2004

(65) Prior Publication Data

US 2005/0057009 A1 Mar. 17, 2005

Related U.S. Application Data

(63) Continuation-in-part of application No. 10/929,367, filed on Aug. 31, 2004.

(30) Foreign Application Priority Data

Sep. 2, 2003 (FR) ..... 03 10366
Aug. 25, 2004 (FR) ..... 04 09074

(51) Int. Cl.
*A63C 9/08* (2006.01)

(52) U.S. Cl. ..... 280/617; 280/611; 280/618; 280/613; 280/11.3

(58) Field of Classification Search ..... 280/617, 280/634, 633, 611, 619, 620, 621, 618, 613, 280/14.22, 11.3, 11.33, 11.34
See application file for complete search history.

(56) References Cited

U.S. PATENT DOCUMENTS 4,969,278 A * 11/1990 Ottieri ..... 36/117.8
5,556,123 A * 9/1996 Fournier ..... 280/607
5,713,587 A 2/1998 Morrow et al.
5,727,797 A * 3/1998 Bowles ..... 280/14.21
5,771,609 A 6/1998 Messmer
5,901,971 A * 5/1999 Eaton ..... 280/14.24
6,065,770 A * 5/2000 Hansen et al. ..... 280/617
6,116,634 A * 9/2000 Mometti ..... 280/613
6,116,635 A * 9/2000 Rigal ..... 280/618
6,206,403 B1 3/2001 Black et al.
6,276,708 B1 8/2001 Hogstedt
6,364,323 B1 * 4/2002 Coulter ..... 280/14.22
6,390,492 B1 * 5/2002 Bumgarner et al. ..... 280/607
6,402,164 B1 6/2002 Gonthier
6,406,040 B1 * 6/2002 Thorne ..... 280/14.21
6,976,684 B2 * 12/2005 Carrasca ..... 280/14.22
2003/0015857 A1 1/2003 Fumagalli
2003/0146600 A1 * 8/2003 Holzer ..... 280/618
2005/0046150 A1 3/2005 Couderc

FOREIGN PATENT DOCUMENTS

FR 2 793 156 A1 11/2000

* cited by examiner

*Primary Examiner*—Christopher P. Ellis
*Assistant Examiner*—John D Walters
(74) *Attorney, Agent, or Firm*—Greenblum & Bernstein, P.L.C.

(57) ABSTRACT

A device for receiving and retaining a foot or a boot on a sports apparatus is disclosed. The device has a seat associated with a rear support element, the rear support element having a support surface facing a free surface, the rear support element being rotatably mounted with respect to the seat, an abutment limiting a rearward rotation of the rear support element, the abutment having a cursor that is movable along the rear support element, as well as a mechanism for immobilizing the cursor on the rear support element. A wall covers the cursor on the side of the free surface, the immobilizing mechanism extending through the wall.

28 Claims, 6 Drawing Sheets

DEVICE FOR RETAINING A FOOT OR A BOOT ON A SPORTS APPARATUS

CROSS-REFERENCE TO RELATED APPLICATIONS

This application is a continuation-in-part of U.S. patent application Ser. No. 10/929,367, filed on Aug. 31, 2004, the disclosure of which is hereby incorporated by reference thereto in its entirety, and the priority of which is hereby claimed under 35 U.S.C. §120.

This application claims priority under 35 U.S.C. §119 of French Patent Application No. 03.10366, which was filed on Sep. 2, 2003, and this application also claims priority under 35 U.S.C. §119 of French Patent Application No. 04.09074, which was filed on Aug. 25, 2004, the disclosures of both of said French patent applications hereby incorporated by reference thereto in their entireties.

BACKGROUND OF THE INVENTION

1. Field of the Invention

The invention relates to a device for receiving and retaining a foot or a boot on a sports apparatus.

2. Description of Background and Relevant Information

Devices of the aforementioned type are used in the fields of snowboarding, snow skiing, water skiing, snowshoeing, roller skating, surfing, and other activities.

Certain devices according to the prior art have a seat provided for receiving the sole of the user's foot or the sole of the user's boot, as well as a rear support element, or highback, provided for supporting the user's lower leg. The rear support element has a support surface facing a receiving zone, the support surface receiving the lower leg.

The seat is associated with the rear support element as follows. Initially, the seat extends lengthwise from a rear end to a front end. The rear support element has a fastening end and a free end, an articulation having a substantially transverse axis connecting the fastening end to the seat. The rear support element is therefore rotatably mounted with respect to the seat. The articulation makes it possible to reduce the bulkiness of the device for its storage by tilting the rear support element forward.

An abutment is provided for limiting a rearward rotation of the rear support element. The abutment can be adjusted in order to adapt the device to the user. For this reason, the abutment has a cursor, or slider, that is movable along the rear support element, as well as a mechanism for immobilizing the cursor on the rear support element. It suffices to act on the immobilizing mechanism to be able to adjust the position of the cursor, and therefore the angular position of the rear support element with respect to the seat.

Generally speaking, the cursor and the immobilizing mechanism are located on the side of the free surface of the rear support element, such that the position of the cursor can be adjusted when the boot is inside or outside of the device. An adjustment is possible because the immobilizing mechanism is directly accessible. This constitutes a characteristic of use of the device.

In the case of snowboarding, it is particularly possible to adjust the angular position of the rear support element with respect to the chassis without removing the boot.

However, it has been noted that, under certain circumstances, the adjustment of the position of the cursor is difficult. This can occur when foreign matter, or debris, hinders the displacement or the immobilization of the cursor along the rear support element.

In snowboarding, for example, snow or ice sometimes constitutes an obstacle against the displacement or immobilization of the cursor. The latter generally has teeth that are adapted to cooperate with teeth of the rear support element. If snow or ice becomes stuck in the teeth, the displacement of the cursor becomes difficult, or even impossible in certain extremes cases. The same is true for the immobilization, as the teeth do not engage, or at least do not engage correctly. Therefore, the user must clean the device, which is often time-consuming and impractical.

SUMMARY OF THE INVENTION

An object of the invention is particularly to facilitate the displacement of a cursor of a retaining device of the aforementioned type along a rear support element, or to facilitate the immobilization thereof.

To this end, the invention proposes a device for receiving a foot or a boot on a sports apparatus, the device having a seat associated with a rear support element, the rear support element having a support surface facing a free surface, the rear support element being rotatably mounted with respect to the seat, an abutment limiting a rearward rotation of the rear support element, the abutment having a cursor that is movable along the rear support element, as well as a mechanism for immobilizing the cursor on the rear support element.

The receiving device according to the invention includes a wall that covers the cursor on the side of the free surface, the immobilizing mechanism extending through the wall.

The wall substantially, or even completely, limits the penetration of foreign material in the area of the cursor. Simultaneously, the immobilizing mechanism remains accessible to the user. Thus, the inclination of the rear support element can be done easily. The absence of foreign material avoids the need for cleaning. A resulting advantage is time saving. Another advantage is the device operating convenience with respect to the adjustment of the inclination of the rear support element.

BRIEF DESCRIPTION OF DRAWINGS

Other characteristics and advantages of the invention will be better understood by means of the description that follows, with reference to the annexed drawings showing, by means of a non-limiting embodiment, how the invention can be embodied, and in which.

DETAILED DESCRIPTION OF THE INVENTION

Although the embodiment described hereinafter relates more particularly to the field of snowboarding, it is to be understood that it applies also to others fields as mentioned above.

The embodiment is shown in FIGS. 1-6.

Figure 1:
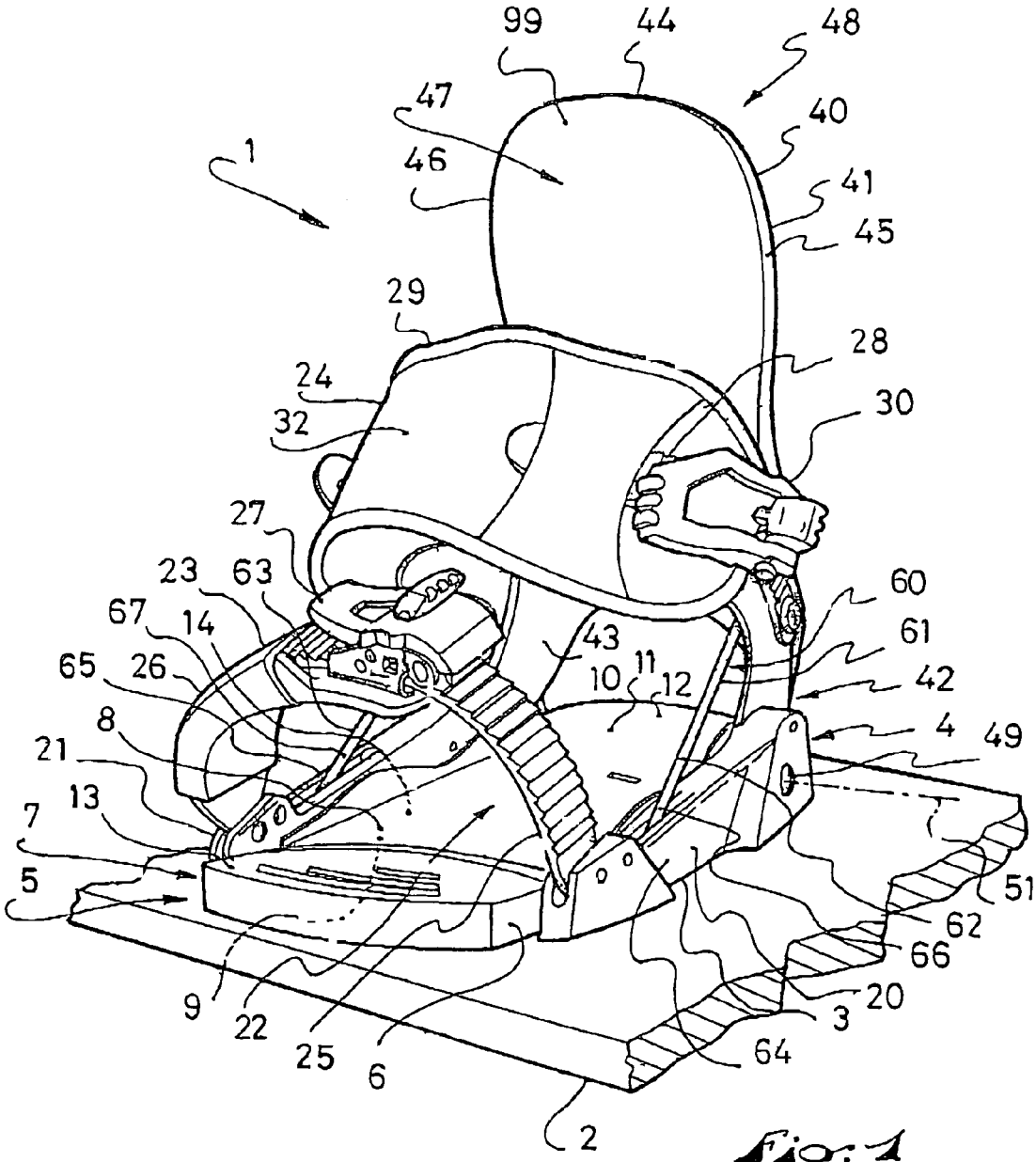
FIG. 1 is a perspective front view of a receiving device according to an embodiment of the invention.
Figure 2:
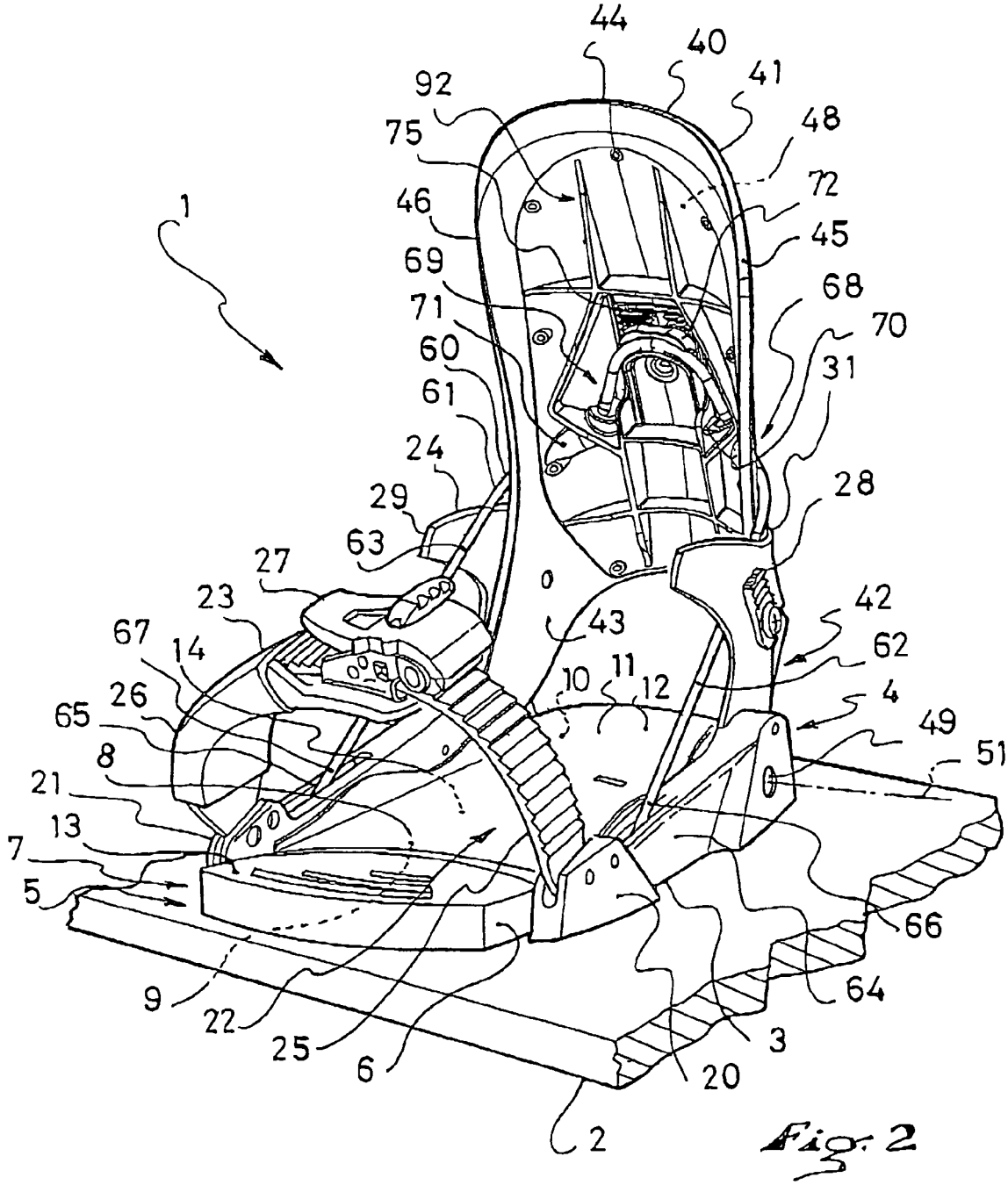
FIG. 2 is a partial view of the device, similar to FIG. 1.
Figure 3:
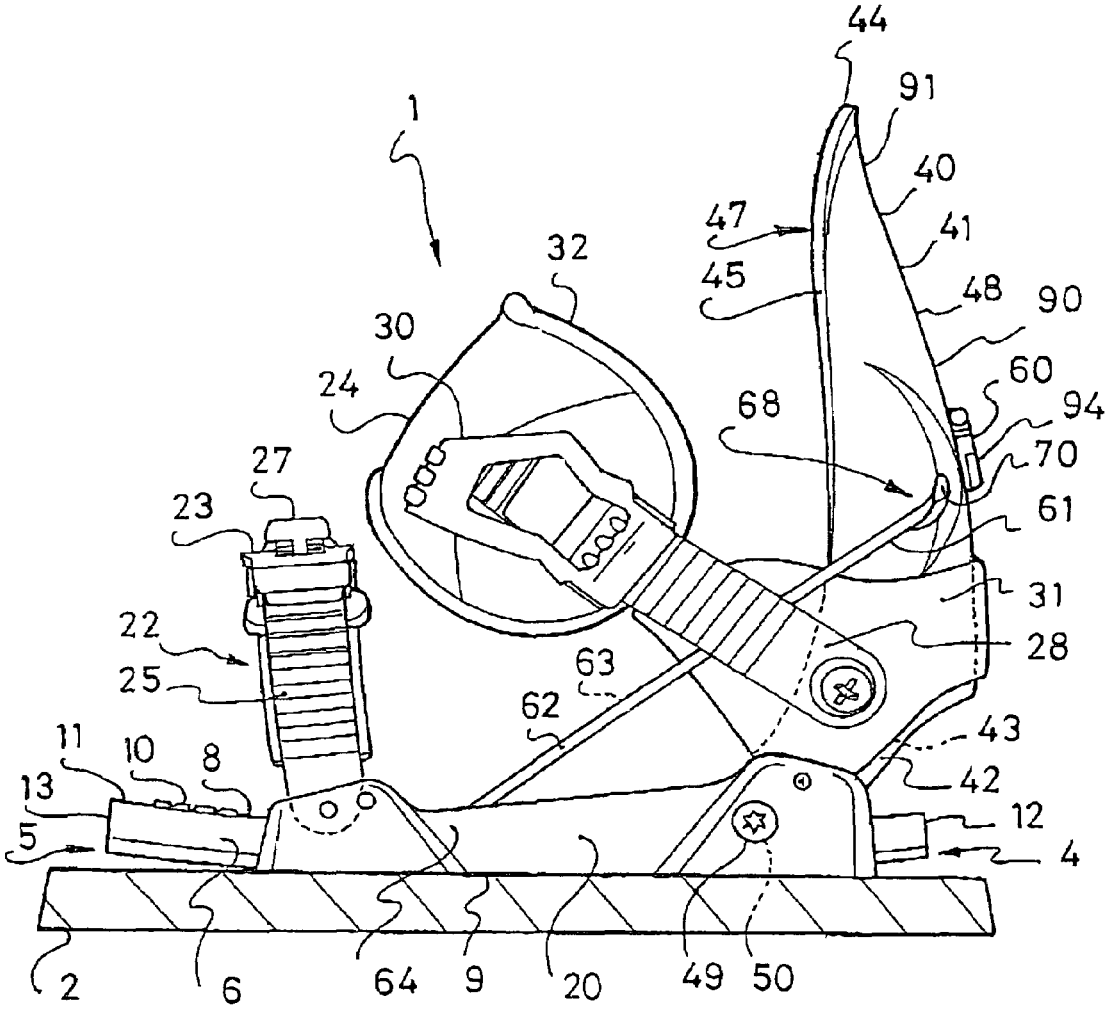
FIG. 3 is a side view of the device of FIG. 1.
Figure 4:
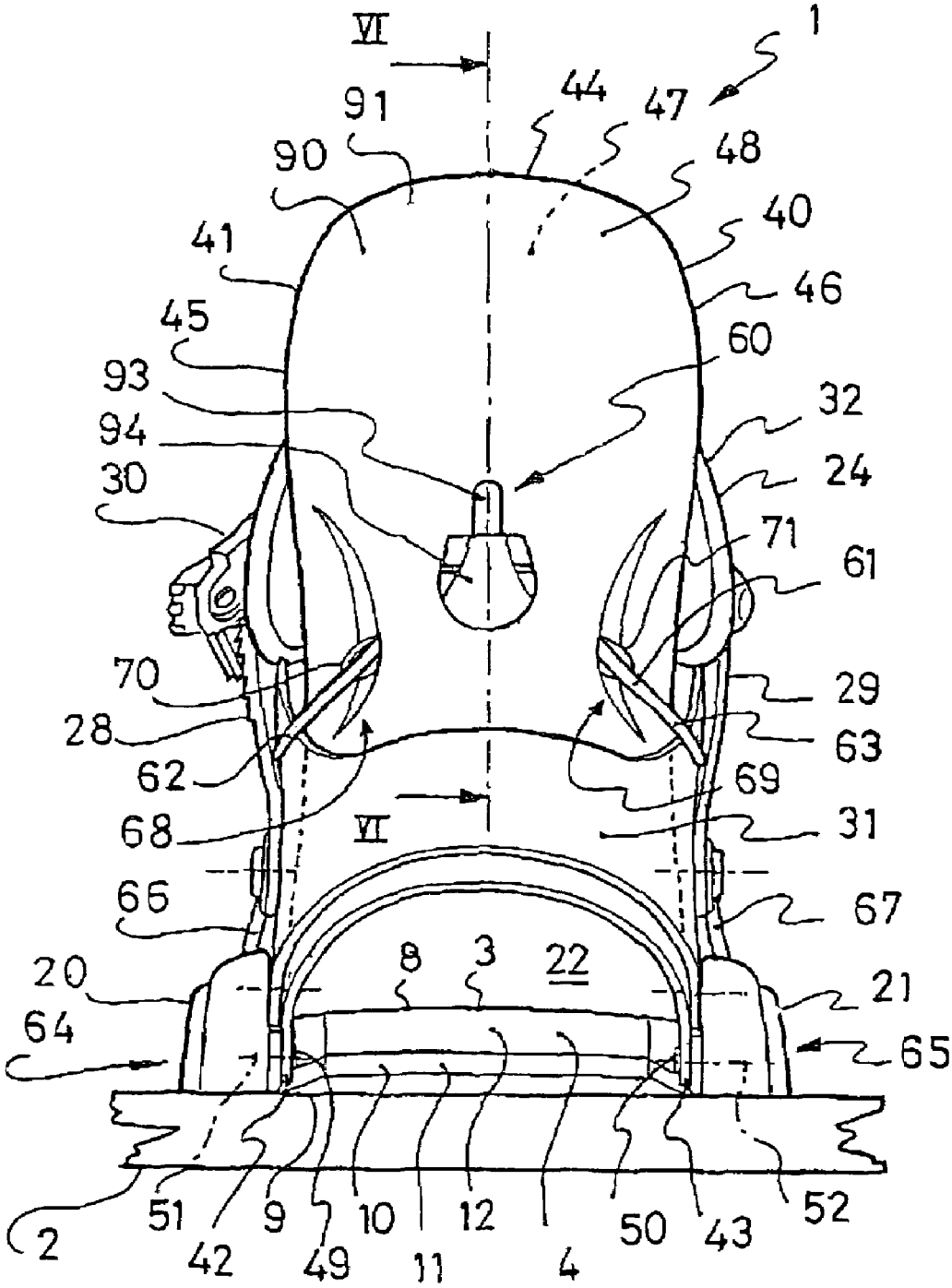
FIG. 4 is a rear view of the device FIG. 1.
Figure 5:
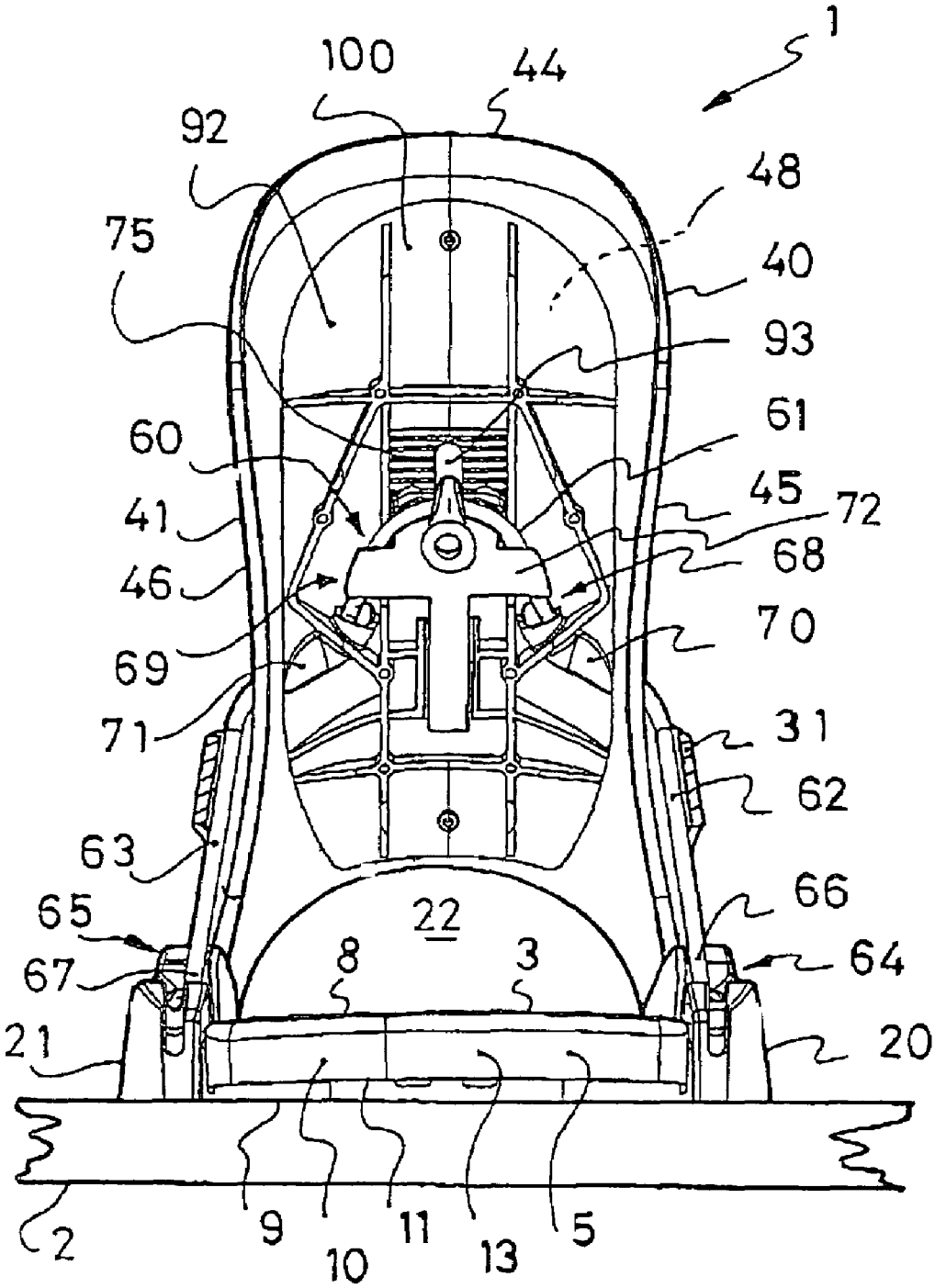
FIG. 5 is partial front view of the device of FIG. 1.

As seen in a perspective view in FIG. 1, a foot or boot retaining device 1 allows the temporary reception of a boot, not shown, on a board 2, such as a snowboard.

As known, the retaining device 1 has a seat 3 that extends lengthwise between a rear end 4 and a front end 5, and widthwise from a first edge 6 to a second edge 7.

The seat 3 has an upper surface 8 provided to be facing the sole of the boot, and a lower surface 9 provided to be above the board 2.

The seat 3 in the particular embodiment illustrated includes a base 10 covered by a pad 11. The base 10 is a rigid element that at least partially demarcates the lower surface 9. The pad 11 at least partially demarcates the upper surface 8. According to the illustrated embodiment of the invention, the pad 11 extends from the rear end 4 to the front end 5 of the seat 3. This enables a cushioned contact with the entire surface of the boot sole. A rear portion 12 and a front portion 13 of the pad 11 demarcate a housing space 14 for the base 10.

Other structures can be provided for the seat 3, such as, for example, a base associated with two pads, one at the rear and the other at the front.

The seat 3 is retained on the board 2 by an arrangement in the form of disk, which is itself retained on the board 2 by screws.

Other means for retaining the seat 3 in position on the board could be provided.

The seat 3 is bordered laterally with a first part shown in the form of a first flange 20, as well as a second part shown in the form of a second flange 21. In this case, the first flange 20 is lateral and the second flange 21 is medial, but this could be reversed. The flanges 20, 21 demarcate a zone 22 for receiving the foot/boot. When the foot/boot is positioned on the device 1, the flanges 20, 21 are positioned to extend laterally along the sole. Something other than the flanges 20, 21 could be provided to form the lateral and medial portions. For example, abutments could be used.

In a particular construction, the base 10 and the flanges 20, 21 form a single unitary element made, for example, from a synthetic material. However, the flanges 20, 21 could be provided to be elements that are affixed to the base by any means, such as adhesive or glue, welding, screws, nesting, or other means or mechanism.

Two linkages, or straps, are also provided for removably retaining the boot on the seat 3, between the flanges 20, 21, in the receiving zone 22.

A first linkage 23 is located toward the front, in the area of the metatarsophalangeal articulation when the foot is retained. A second linkage 24 is located toward the rear, in the area of the instep when the foot is retained.

Each of the linkages 23, 24 extends transversely between the flanges 20, 21.

A different number of linkages could be provided.

The first linkage 23, for example, has a lateral portion 25 and a medial portion 26, which are attached to the lateral 20 and medial 21 flanges, respectively. A connecting device 27 makes it possible to reversibly connect the lateral 25 and medial 26 portions to one another. The connecting device 27 makes it possible to tighten the boot on the device to a desired level.

In the same context, the second linkage 24, for example, has a lateral portion 28 and a medial portion 29, which are attached to the lateral 20 and medial 21 flanges, respectively. Here again, a connecting device 30 makes it possible to reversibly connect the lateral 28 and medial 29 portions to one another. The connecting device 30 makes it possible to tighten the boot to the desired level.

The second linkage 24 also has, according to the illustrated embodiment, a rear segment 31. The latter extends the second linkage 24 toward the rear, in order to go around the heel or the rear of the user's ankle or lower leg. Consequently, the association of the lateral 28 and medial 29 portions forms a front segment 32 of the second linkage 24. Therefore, the linkage 24 completely surrounds the user's ankle or lower leg. A resulting advantage is a better retention of the foot or the boot on the seat.

Whether or not it has the rear segment 31, the second linkage 24 always enables the function of retaining the boot on the device 1.

The device 1 also has a rear support element 40, or highback, so that the user can take rear supports with the lower leg, i.e., so that the lower leg of the user can be supported rearwardly during riding.

The rear support element 40 has a body 41 that extends longitudinally between first 42 and 43 fastening ends and a free end 44, transversely between a first edge or lateral edge 45 and a second edge or medial edge 46, and in thickness between a support surface 47 and a free surface 48.

The support surface 47 is provided for receiving the rear of the user's lower leg, the rear support element 40 and the base 10 being consequently associated.

According to the embodiment illustrated, as generally seen in FIGS. 1-6, the rear support element 40 is rotatably mounted with respect to the seat 3. To this end, the rear support element is connected to the flanges 20, 21 by means of a first articulation 49 located in the area of the first fastening end 42, and by means of a second articulation 50 located in the area of the second fastening end 43. Each articulation 49, 50 is oriented substantially along a first 51 and a second 52 transverse axis, respectively, of the device 1. Each articulation 49, 50 can include any component, such as a screw, a rivet, a washer, a nut, a pin, or the like.

Each articulation 49, 50 enables a rotational movement of the rear support element 40 toward the seat 3. A resulting advantage is to facilitate storage of the device.

According to the embodiment illustrated, an abutment 60 limits the rearward rotation of the rear support element 40.

In a non-limiting fashion, the abutment 60 has a link 61 that extends along the rear support element 40. The link 61 is arranged on the seat 3 and cooperates with the rear support element 40 to limit the rearward rotation of the rear support element 40. The path of the link 61 can be tracked as follows. For example, the link 61 has a first portion or lateral portion 62 and a second portion or medial portion 63, one extending the other. Each portion 62, 63 of the link 61 is connected to the base 10 by a first 64 and a second 65 lower connection, respectively. The lower connections 64, 65 are each located at the front of the first 49 or second 50 articulation.

The link 61 can take the form of a cable, such cable having a first end or lateral end 66, as well as a second end or medial end 67. Each of the ends 66, 67 is connected to the lateral 20 or medial 21 flange by any means known to the one with ordinary skill in the art, in order to form the first 64 and second 65 lower connections. The use of a crimped end piece is suitable. Between the lower connections 64, 65, the cable 61 follows each flange 20, 21 by moving away therefrom, so as to extend along the rear support element 40 in a position that is farther from the flanges.

More specifically, the first portion 62 and the second portion 63 are each connected to the rear support element 40 by a first 68 and second 69 upper connections, which are located between the first 42 or second 43 fastening end, respectively, and the free end 44. In a non-limiting fashion, the upper connections 68, 69 each have a first 70 and second 71 guides.

An arrangement is also provided for adjusting the angular position of the rear support element 40 with respect to the base 10. Depending upon this arrangement, the abutment 60 has a cursor 72, or slider, that is movable along the rear support element 40. The cursor 72, located between the guides 70, 71, retains the cable 61. It suffices to bring the cursor 72 closer to or to move it away from the free end 44 to modify the free length, or effective length, of the portions 62, 63 of the link 61, between the lower connections 64, 65 and the rear support element 40. To this end, any immobilizing mechanism known to one of ordinary skill in the art is suitable. The immobilizing mechanism has, for example, a screw 73 for tightening or loosening the cursor 72 in relation to the rear support element 40. Here, the immobilizing mechanism has complementary teeth 74, 75 on the cursor 72 and on the rear support element 40, respectively, which enable a positioning of one on the other. These teeth 74, 75 are well known to one of ordinary skill in the art. These teeth 74, 75 enable an immobilization by obstacle of the cursor with respect to the rear support element. However, an immobilization by friction can alternatively be provided. In this case, the teeth disappear in favor of even surfaces.

According to the invention, a wall 90 covers the cursor 72 on the side of the free surface 48, the mechanism for immobilizing the cursor 72 extending through the wall 90.

The wall 90 substantially or completely limits the penetration of foreign material, such as ice, snow, or debris, in the area of the cursor 72. Simultaneously, the immobilizing mechanism is accessible to the user. Thus, the adjustment of the inclination of the rear support element can be accomplished easily. The absence of foreign material enables the cursor to be displaced easily.

Figure 6:
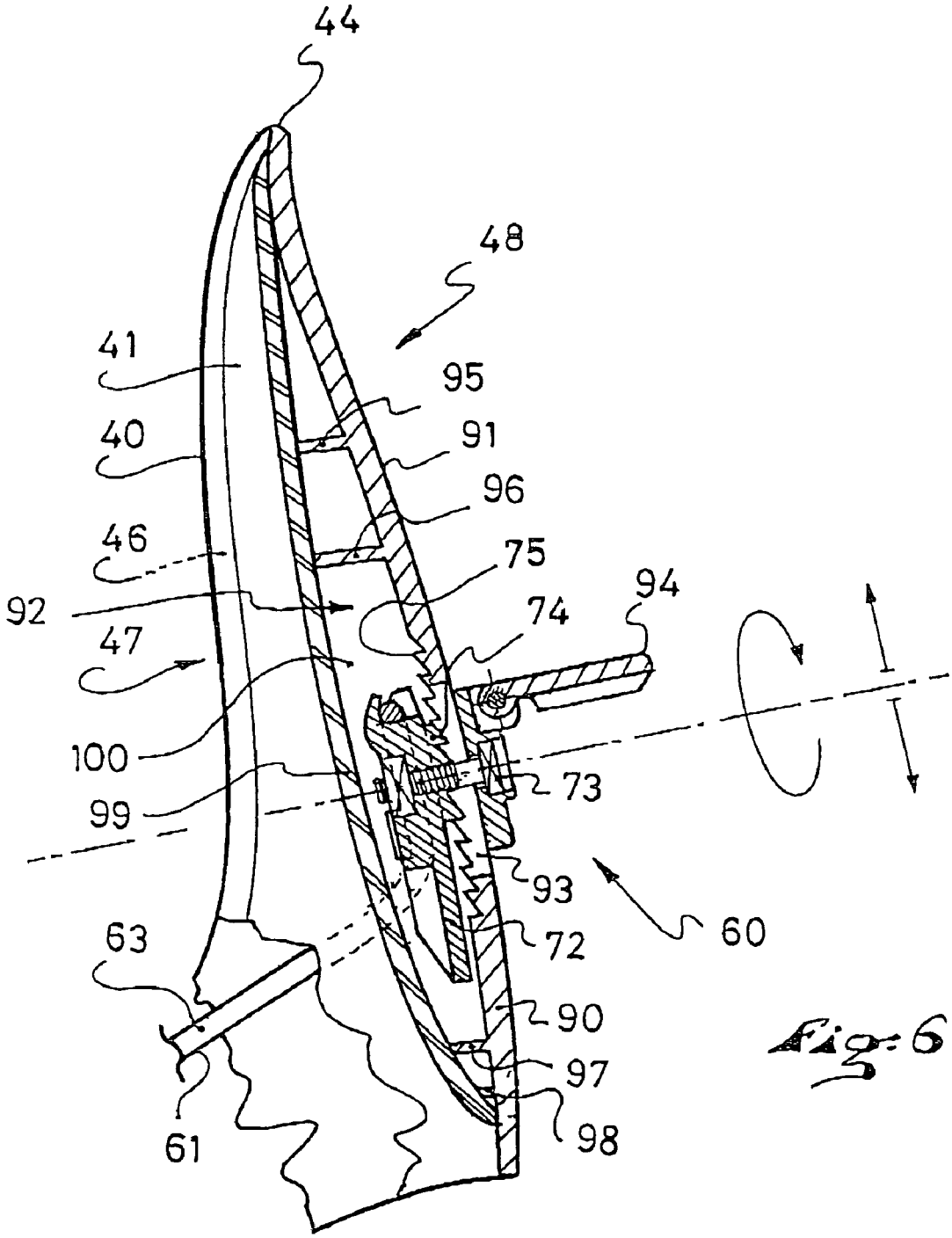
FIG. 6 is a cross-sectional view along the line VI-VI of FIG. 4, which line represents a vertical longitudinal median plane of the device.

According to the illustrated embodiment, the wall 90, which covers the cursor 72, is a reinforcement that extends longitudinally substantially from the fastening ends 42, 43 up to the free end 44 of the rear support element 40. As shown in FIG. 6. the rear wall 90 extends downwardly from the uppermost end 44 to form the lowermost extent of the rear support element at an intersection with a vertical longitudinal median plane of the retaining device. In the transverse direction, the reinforcement 90 extends substantially from the lateral edge 45 up to the medial edge 46. In thickness, the reinforcement 90 has a free surface 91 opposite a front surface 92. The free surface 91 merges with the free surface 48 of the rear support element 40. In other words, the reinforcement 90 is the rearmost and largest portion of the rear support element 40. The reinforcement 90 is a reinforcing wall for the rear support element 40 and provides the rear support element 40 with a large portion of its mechanical strength. The reinforcement 90 is made of relatively rigid materials, such as metals or plastic materials.

The free surface 91 is substantially convex in the transverse direction, which enables the rear support element 40 to withstand the forces coming from the user's lower leg and to better receive the lower leg.

The free surface 91 has a continuous curvature which promotes an easy steering, as a possible obstacle would tend to slide over the free surface 91 without getting caught thereon. For example, powder snow which rubs against the rear support element 40 only slightly sticks, or does not stick to the element 40. In other words, penetration in deep snow is improved.

The thickness of the reinforcement 90 is constant, or substantially constant, in order to facilitate the manufacture of the rear support element as well as the adjustment of the position of the cursor 72. Indeed, the screw 73 extends through the reinforcement 90 via a slit 93. This slit 93 is oriented longitudinally with respect to the rear support element 40, through the teeth 75, since the teeth 75 are located on the reinforcement 90. A constant thickness of the reinforcement 90 enables an immobilization of the cursor 72, or a release, for a same number of screw pitches, regardless of the longitudinal position of the screw 73 in the slit 93.

In order to allow manipulation without a tool, a handle 94 associated with the screw 73 is provided. For example, the handle 94. or manipulation element, is articulated in relation to the screw 73. The handle 94 can be deployed in order to turn the screw 73, as is the case in FIG. 6. Conversely, the handle 94 can be folded in order to reduce the bulkiness, as is the case in FIGS. 1-5.

Any other method for actuating the screw can be provided, including the use of a tool.

Alternatively, other mechanisms for immobilizing the cursor can be provided, such as a cam mechanism.

According to the illustrated embodiment, the cursor 72 is movable in relation to the reinforcement 90 which covers the cursor 72. Given that this reinforcement 90 constitutes a continuous element connected to the seat 3, the rear support element 40 is maintained in angular position since the cursor 72 is immobilized.

It appears that the cursor 72 and the handle 94 are on both sides, respectively, of the same wall or reinforcement 90.

The cursor 72 is on the side of the boot, facing the front surface 92, whereas the handle 94 is on the side of the free surface 91, accessible to the user under any circumstances.

Consequently, the teeth 75 of the rear support element 40 are on the side of the boot, on the front surface 92.

To improve the mechanical strength of the rear support element, a stiffening structure can be provided. The latter can include, for example, ribs 95, 96, 97, 98 that project with respect to the front surface 92. In addition to a stiffening function, the ribs 95, 96, 97, 98 make it possible to reduce the mass of the rear support element 40.

As can be well understood particularly with reference to FIG. 6, a cover 99 or cap is provided to at least partially form the support surface 47 of the rear support element 40. The cover 99 is supported on the ribs 95, 96, 97, 98, as well as on the front surface 92. Thus, the cover 99 can transmit the supports, or forces, coming from the user's lower leg, to the wall or reinforcement 90. Consequently, these forces are transmitted to the abutment 60.

The cover 99 covers the cursor 72 and the teeth 74, 75 on the side of the support surface 47. With the reinforcement 90, the cover 99 forms an enclosure 100 for housing the cursor 72. The enclosure is almost closed, with the exception of the slit 93 for the passage of the screw 73, and guides 70, 71 for the passage of the link 60. The slit 93 is smaller in size with respect to the cursor 72, and, in addition, the handle 94 covers the slit at least partially, such that foreign material does not substantially penetrate into the enclosure 100. In the area of the guides 70, 71, the clearance between the link 60 and each guide is reduced, thus making it almost impossible for foreign material to pass through. Thus, the adjustment of the position of the cursor 72 is done under good conditions.

Generally speaking, the invention is made from materials and according to implementation techniques known to one of ordinary skill in the art.

The invention is not limited to the particular embodiment described, and the particular details thereof, and includes all of the technical equivalents that fall within the scope of the claims that follow.

For example, the rear support element can be made to have a different structure from the particular structure shown and described heretofore.

A rear support element 40 has been described above with a rear wall or reinforcement 90 that extends substantially over the entire surface of the element 40, a front wall or cover 99 covering the front to form an enclosure 100. Such cover has an outer periphery which completely surrounds the cursor. However, alternatively, a reverse arrangement is possible. The reinforcement can be at the front, the cover covering the rear. In this second configuration, the cursor can be housed between a reinforcement and a cover. But it is then the cover that acts as the wall for covering the cursor in the context of the invention.

The covering wall, whether it is formed by the reinforcement or by the cover, can have a shape such as, for example, that which would demarcate a reduced enclosure for the displacement of the cursor. The free surface 48 would then have a hollow boss.

In addition, one or several deformable plugs can be provided in the slit 93 through which the screw 73 extends. These plugs would be more or less compressed depending upon the position of the screw in the slit. The plugs further improve the impermeability of the enclosure 100.

What is claimed is:

1. A device for retaining a foot or a boot on a sports apparatus, the device comprising:

a seat;

a rear support element having a support surface opposing a free surface, the rear support element being rotatably mounted with respect to the seat;

an abutment limiting a rearward rotation of the rear support element, the abutment including a cursor movable along the rear support element, and a mechanism to immobilize the cursor on the rear support element;

a wall covering the cursor on the side of the free surface, the immobilizing mechanism extending through the wall, the wall covering an upper end and a lower end of the cursor, the wall further extending upwardly beyond the upper end of the cursor and downwardly beyond the lower end of the cursor.

2. A retaining device according to claim 1, wherein:

a seat;

a rear support element having a forward-facing support surface and a rearward-facing free surface, the rear support element being rotatably mounted with respect to the seat;

an abutment limiting a rearward rotation of the rear support element, the abutment including a cursor movable along the rear support element, and a mechanism to immobilize the cursor on the rear support element;

a wall covering the cursor on the side of the free surface, the immobilizing mechanism extending through the wall;

the wall is a reinforcement wall for the rear support element, said reinforcement wall extending longitudinally substantially from a plurality of fastening ends of the rear support element up to a free end of the rear support element, transversely substantially from a lateral edge up to substantially a medial edge of the rear support element, and in thickness between the free surface and a front surface.

3. A retaining device according to claim 1, wherein:

the immobilizing mechanism of the cursor includes a screw extending through the wall via a slit.

4. A retaining device according to claim 1, wherein:

the immobilizing mechanism of the cursor includes complementary teeth on the cursor and on the wall, respectively.

5. A retaining device according to claim 3, further comprising:

a handle associated with the screw, the cursor and the handle being on opposite sides, respectively, of the reinforcement wall.

6. A retaining device according to claim 1, wherein:

a cover at least partially forms the support surface of the rear support element.

7. A retaining device according to claim 1, wherein:

the free surface is substantially convex in a transverse direction.

8. A retaining device according to claim 1, wherein:

the free surface has a continuous curvature.

9. A retaining device according to claim 1, wherein:

the wall covering the cursor on the side of the free surface is a cover.

10. A retaining device according to claim 1, further comprising:

a plurality of linkages for removably retaining the foot or boot on the seat.

11. A retaining device according to claim 1, wherein:

the cursor is mounted for up and down movement relative to the wall for positional adjustment of said cursor prior to immobilization of the cursor.

12. A retaining device according to claim 1, wherein:

the cursor is housed for movement within a fixed enclosure between the support surface of the rear support element and the free surface.

13. A retaining device according to claim 1, wherein:

the immobilizing mechanism comprises an arrangement for positional adjustment of the cursor relative to the wall and relative to the rear support element.

14. A retaining device according to claim 1, wherein;

the wall is fixed in position relative to the rear support element against movement and adjustability.

15. A retaining device according to claim 4, wherein:

the teeth of the immobilizing mechanism are housed against exposure between the wall and the rear support element in all positions of the cursor relative to the rear support element.

16. A retaining device according to claim 4, wherein:

the teeth of the immobilizing mechanism on the wall face forwardly;

the teeth of the immobilizing mechanism on the wall are engageable with the teeth on the cursor.

17. A retaining device according to claim 1, wherein:

the support surface of the rear support element faces forwardly for supporting a rider's lower leg, and the free surface faces rearwardly.

18. A retaining device according to claim 1, wherein:

the seat is bordered by first and second flanges demarcating a zone for receiving the foot or the boot;

the wall comprises first and second fastening ends;

the rear support element being rotatably mounted with respect to the seat by means of first and second articulations connecting the first and second fastening ends of the wall with the first and second flanges, respectively.

19. A retaining device according to claim 1, wherein:

a cover is positioned forward of the wall;

an enclosure is defined between said cover and said wall;

the cursor is housed within the enclosure and is spaced from said cover when the cursor is immobilized relative to the rear support element.

20. A device for retaining a foot or a boot of a rider on a sports apparatus, the device comprising:

a seat for supporting the foot or the boot;

a rear support element being articulated for selective forward movement and rearward movement above the seat, said rear support element comprising:

a front wall comprising a forward-facing surface adapted to support a lower leg of the rider;

a rear wall comprising a rearward-facing surface;

an enclosure between said front wall and said rear wall;

an abutment structured and arranged to limit said rearward movement of the rear support element at any of a plurality of angular positions of said rear support element, said abutment comprising:

a cursor mounted for movement relative to said rear wall, said cursor being completely contained within said enclosure during said movement of said cursor;

a mechanism to adjust a position of said cursor relative to said rear wall to any of a plurality of different positions relative to said rear wall and to selectively immobilize said cursor relative to said rear wall in any of said positions.

21. A retaining device according to claim 20, wherein:

said rear wall includes a slot elongated upwardly and downwardly;

said mechanism to adjustably position and immobilize said cursor relative to said rear wall comprises a pin extending through said slot and a manipulable member connected to said pin and positioned rearward of said rear wall for manipulation by a user.

22. A retaining device according to claim 20, wherein:

said cursor comprises a plurality of rearwardly facing teeth;

said mechanism to adjustably position and immobilize said cursor relative to said rear wall comprises a plurality of forwardly facing teeth permanently fixed against movement relative to said rear wall for engagement with said teeth of said cursor.

23. A retaining device according to claim 20, wherein:

said mechanism to adjustably position and immobilize said cursor relative to said rear wall comprises a mechanism to adjustably position and tighten said cursor against a surface of said rear wall in any of said plurality of positions relative to said rear wall.

24. A retaining device according to claim 20, wherein:

said rear wall has an outer periphery completely surrounding said cursor.

25. A device for retaining a foot or a boot of a rider on a sports apparatus, the device comprising:

a seat for supporting the foot or the boot;

a rear support element being articulated for selective forward movement and rearward movement above the seat, said rear support element comprising:

a forward wall having a forward-facing surface area;

a rear wall having a rearward-facing surface area, said rearward-facing surface area being greater than said forward-facing surface area;

an enclosure between said forward wall and said rear wall;

an abutment structured and arranged to limit said rearward movement of the rear support element at any of a plurality of angular positions of said rear support element, said abutment comprising:

a cursor mounted for movement relative to said rear wall;

a mechanism to adjustably position of said cursor relative to said rear wall in any of a plurality of positions relative to said rear wall and for selective immobilization of said cursor relative to said rear wall in any of said positions;

said cursor being contained within said enclosure in all of said plurality of positions of said cursor.

26. A retaining device according to claim 25, wherein:

said rear wall is a reinforcement wall for said rear support element and forms a lowermost extent of said rear support element at an intersection with a vertical longitudinal median plane of the retaining device.

27. A retaining device according to claim 26, wherein:

said reinforcement wall includes reinforcing ribs.

28. A retaining device according to claim 27, wherein:

said forward wall is supported on said reinforcing ribs of said reinforcement wall.

* * * * *